United States Patent [19]

Fontana

[11] 4,065,176

[45] Dec. 27, 1977

[54] CHAIR CONTROL

[75] Inventor: Frank J. Fontana, Stratford, Conn.

[73] Assignee: Stewart-Warner Corporation, Chicago, Ill.

[21] Appl. No.: 715,910

[22] Filed: Aug. 19, 1976

[51] Int. Cl.[2] ..... A47C 3/00; A47C 1/024

[52] U.S. Cl. ..... 297/304; 297/353; 297/361; 403/353

[58] Field of Search ..... 297/300, 304, 306, 307–309, 297/354, 355, 345, 296–298, 410, 353, 361; 248/373, 223, 220.5, 207, 298, 295, 296; 403/353

[56] References Cited

U.S. PATENT DOCUMENTS

| | | | |
|---|---|---|---|
| 1,359,145 | 11/1920 | Atwood | 297/304 |
| 2,271,250 | 1/1962 | Buchholz | 248/223 X |
| 3,133,763 | 5/1964 | Stoll et al. | 297/304 |
| 3,552,796 | 1/1971 | Williams | 297/304 |
| 3,881,772 | 5/1975 | Mohrman | 297/304 X |

*Primary Examiner*—Roy D. Frazier
*Assistant Examiner*—William E. Lyddane

[57] ABSTRACT

A chair control mechanism for supporting both the seat and back rest of a chair, including a seat frame with a control member mounted for limited pivotal movement thereon for supporting the back rest. A torsion spring resiliently urges the control member and back rest in one direction. A back hinge is pivotally mounted on the control member and is adjustable with the aid of a threaded adjustment member and a second torsion spring to provide a positive attitude adjustment for the back rest. A back rest strap is provided carrying the back rest at its upper end and having at its lower end a T-shaped bayonet projection received in an elongated aperture in the back hinge in addition to a threaded fastener so that if for any reason the fastener fails, the back rest will not fall off.

4 Claims, 7 Drawing Figures

FIG. 5
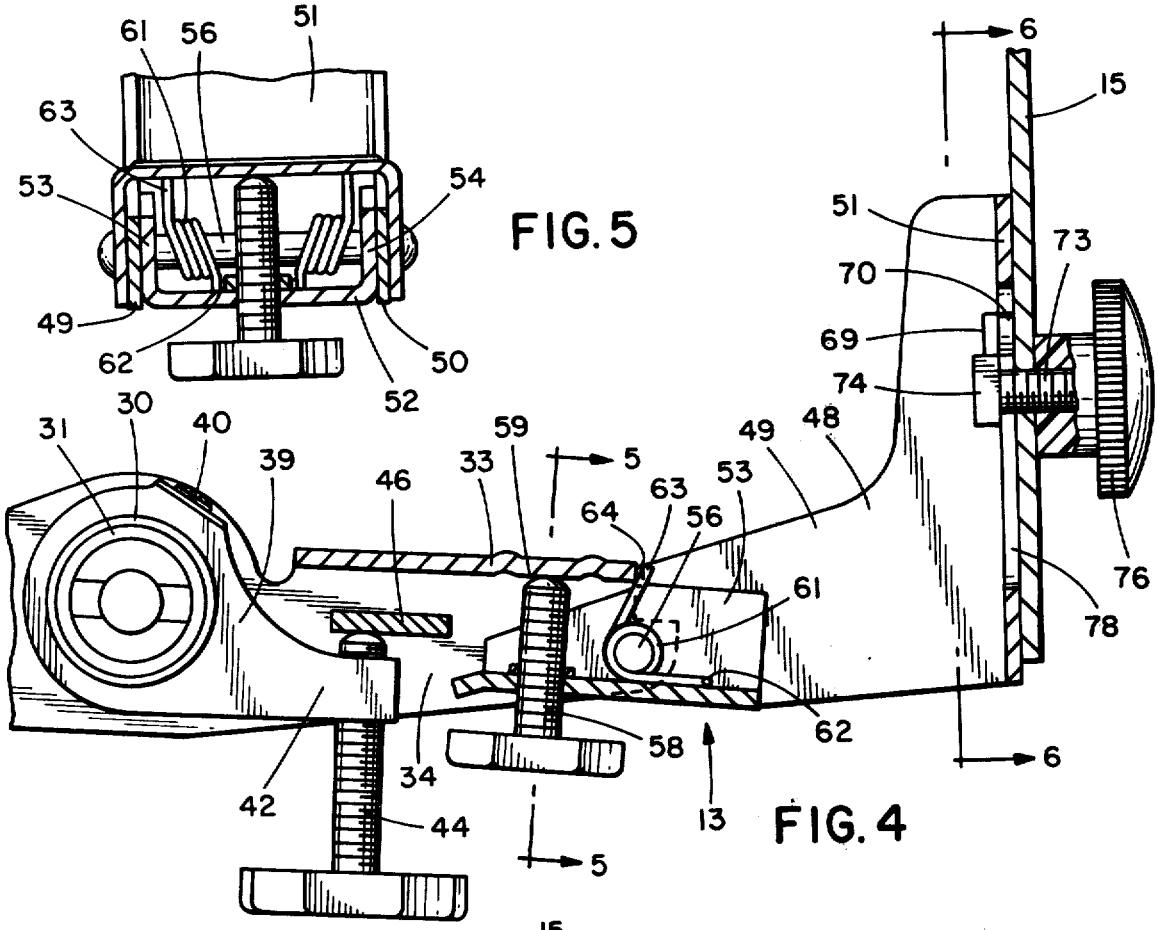
FIG. 4
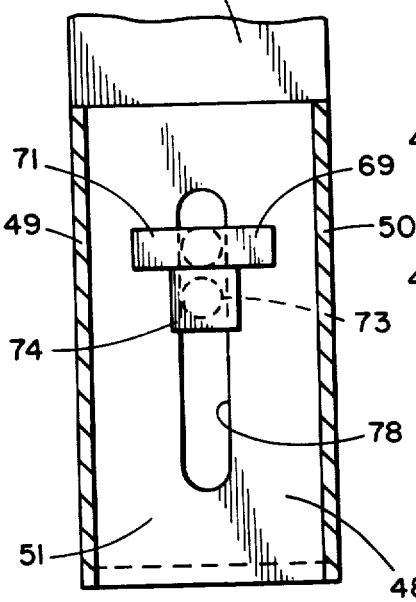
FIG. 6
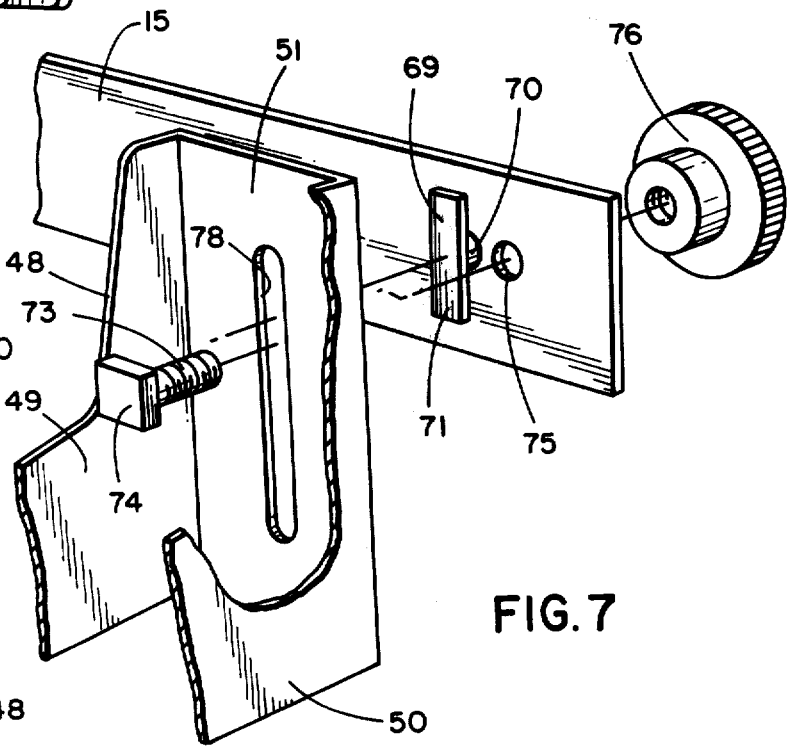
FIG. 7

CHAIR CONTROL

BACKGROUND OF THE PRESENT INVENTION

A plurality of chair controls have been provided in the past to support the seat and back rest of a stenographic type chair. These conventionally include a seat frame adapted to support the seat and fixed to the basic threaded vertical post. To provide for limited pivotal movement of the back rest as back pressure is placed upon it, a control member is mounted on the seat frame for limited pivotal movement. This control member is continually spring biased in a direction so as to urge the back rest in a forward direction, and conventionally this spring is adjustable to vary the tension on the back rest. A back strap is conventionally provided, sometimes with a vertical adjustment, fixed to the control member and projecting upwardly to a position where it directly supports the back rest.

There are two basic problems in these prior chair controls. The first is that the back rest has no positive attitude adjustment, and secondly, when the back strap fastener connecting it to the control member became loose or failed, the back strap and the back rest could easily fall from the chair causing injury to the user.

SUMMARY OF THE PRESENT INVENTION

In accordance with the present invention, an improved chair control is provided that permits the attitude of the back rest to be positively adjusted, and also provides a fail safe lock for the back strap preventing the back rest from inadvertent failure. The present chair control has the basic elements of prior art mechanisms, namely a seat frame fixed to the vertical support post and a control member mounted for limited pivotal movement on the seat frame and biased toward a position moving the back rest forwardly by an adjustable spring mechanism.

A back hinge is provided pivotally mounted on the control member to give a positive attitude adjustment for the back rest. This back hinge is adjustable by a threaded member, and is held in position by a torsion spring at a pivot between the back hinge and the control member. The spring also aids in providing a smooth adjustment for the threaded member.

Also provided is a vertically adjustable back strap between the back hinge and the back rest itself. This back strap has a T-shaped projection near its lower end that is received in an elongated slot in the back rest and provides a fail safe connection between the back strap and the back hinge in the event that the threaded fastener connecting the back strap to the back hinge fails or loosens. This bayonet type projection is fail safe in the sense that it requires a 90 degree rotation of the back strap in order to remove the projection from the slot in the back hinge. This connection, of course, provides the vertical adjustment of the back strap and hence the back rest.

BRIEF DESCRIPTION OF THE DRAWINGS

FIG. 4 is a longitudinal fragmentary section taken generally along line 4—4 of FIG. 3;

FIG. 5 is a fragmentary section taken generally along line 5—5 of FIG. 4;

FIG. 6 is a fragmentary section taken generally along line 6—6 of FIG. 4; and

FIG. 7 is a fragmentary exploded view of the back strap connection with the back hinge.

DETAILED DESCRIPTION OF THE PREFERRED EMBODIMENT

Figure 1:
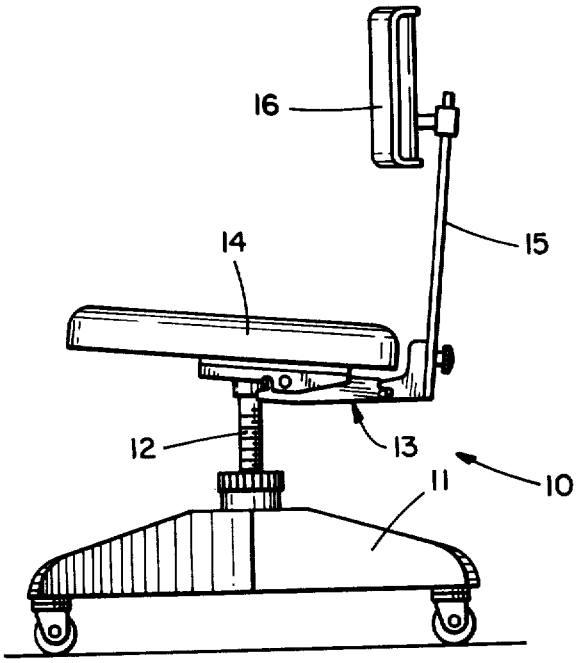
FIG. 1 is a side view of the stenographer's chair incorporating a chair iron according to the present invention.

Viewing the drawings and particularly FIG. 1, a stenographic chair 10 is illustrated having legs 11 supporting a central vertical post 12. The post 12 is fixed to a chair control mechanism 13 which supports a seat 14 and has a back strap 15 projecting upwardly therefrom carrying a back rest 16.

Figure 2:
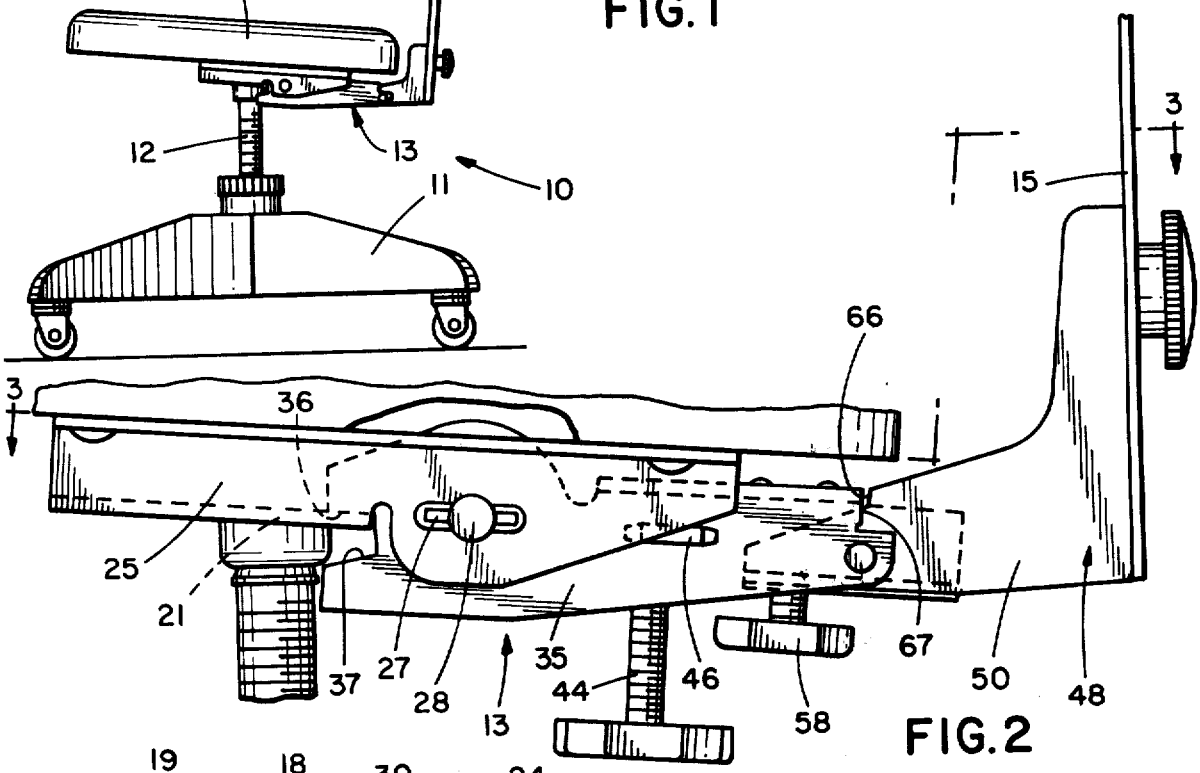
FIG. 2 is an enlarged side view of the present chair control mechanism.
Figure 3:
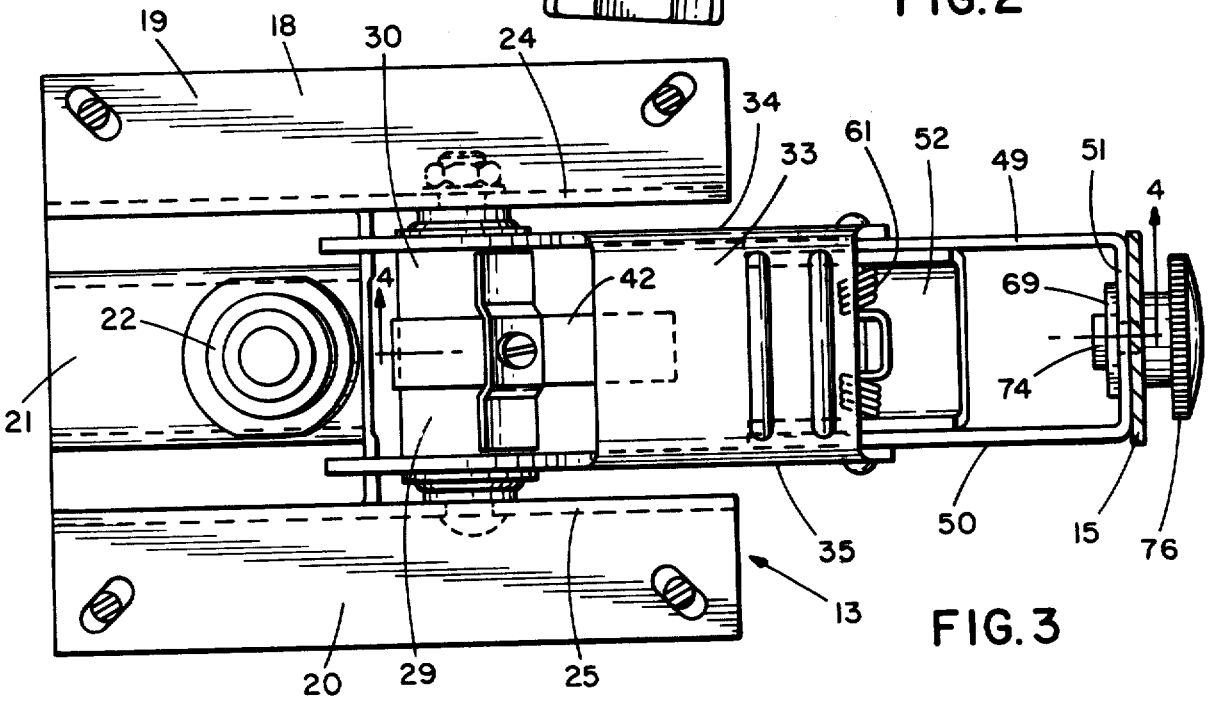
FIG. 3 is a cross-section taken generally along line 3—3 of FIG. 2.

As seen more clearly in FIGS. 2 and 3, the chair control 13 includes a seat frame member 18 having flange portions 19 and 20 fixed to the bottom of seat and an integral interconnecting web portion 21. The web portion 21 has a boss 22 for receiving the upper end of the threaded post 12. Depending flanges 24 and 25 on the seat frame 18 have openings 27 for receiving a fastening element 28 that carries a torsion spring assembly 29. As described more clearly in the Harry L. Mohrman U.S. Pat. No. 3,881,772, issued May 6, 1975, assigned to the assignee of the present invention, the torsion spring assembly 19 includes an outer sleeve 30 mounted on a resilient sleeve 31 (FIG. 4). A U-shaped control member 33 is provided having downwardly extending flanges 34 and 35. The flanges 34 and 35 have openings that are pivotally received on the outer sleeve 30 of the torsion spring assembly 29.

The pivotal movement of the control member 33 on the sleeve 30 is limited by the engagement of inwardly facing shoulders 36 and 37 projecting forwardly from the control member flanges 34 and 35. The shoulder 36 is normally biased into engagement with the frame web 21 by ring 39 fixed to sleeve 30 by threaded member 40 (see FIG. 4). The ring 39 has a rearward projection 42 threadedly receiving member 44 which engages a cross-member 46 fixed to and carried by the downwardly depending side flanges 34 and 35. Thus, adjustment of the threaded member 44 will control the tension on control member 33 and hence the resistance to backward movement of the back rest 16.

A U-shaped back hinge 48 includes forwardly projecting side members 49 and 50 and an interconnecting vertical web portion 51. Extending between the forward end of the U-shaped hinge member 48 is a U-shaped member 52 having upwardly projecting flanges 53 and 54. The U-shaped member 52 is welded to the flanges 49 and 50 of the back hinge 48. The back hinge 48 and the U-shaped member 52 are pivotally mounted on control member 33 by a cross-pin 56 which projects through flanges 53 and 54, side members 49 and 50 as well as downwardly projecting flanges 34 and 35 of the control member 33. To adjust the pivotal position of the back hinge 48 about a horizontal axis and hence the attitude or angle of the back rest 16, a threaded member 58 is provided threadedly received in the web of the U-shaped member 52 and engageable with surface 59 on the web portion of control member 33. A coil torsion spring 61 surrounds the pin 56 and has a first end portion 62 engaging the web or member 52 and a second end portion 53 engaging end surface 64 on control member 33. Thus, spring 61 continuously urges the hinge 48 in a backward direction providing a positive positioning for the back hinge and back rest 16 as well as assisting in the adjustment of the back hinge and back rest by threaded member 58.

The side flanges 49 and 50 have abutments 66 which engage end surfaces 67 on the side flanges 34 and 35 for the purpose of limiting the pivotal movement of the back hinge 48.

The back strap 15 has a fail-safe connection with the back hinge 48 to prevent the accidental displacement of the back strap and hence the back rest 16 from support by the back hinge 48. Toward this end, the back strap 15 has a T-shaped projection 69 having a lower cylindrical portion 70 and a top rectangular bar 71. The bar 71 is positioned perpendicular to the longitudinal extension of the back strap 15. The length of the cylindrical projection 70 is just slightly greater than the width of the web portion 51 of back hinge 48 as seen in FIG. 4. In this manner, the projection 69 holds the back strap 15 in position.

For adjustably positioning the back strap 15 on the back hinge 48, a threaded fastener 73 is provided having a square head 74. The head 74 is sized with respect to aperture 75 in the back strap so that the head engages the lower surface of the bar 71. Thus, the threaded member 73 projects through slot 78 in hinge web 51, through aperture 75 in the back strap 15 and into threaded knob 76. It is only necessary to loosen knob 76 to permit the vertical adjustment of the back strap 15.

To assemble the back strap 15 to the back hinge 48, the back strap 15 must be rotated 90 degrees to the position shown in FIG. 7. The projection 69 is then inserted in vertical slot 78 in the back hinge 15 and strap 15 is rotated 90° to a vertical position where aperture 75 will be aligned with the slot 78. This permits the insertion of threaded fastener 73 into slot 78, through aperture 75 and the attachment of the threaded knob 76.

If for any reason the control knob 76 inadvertently loosens or becomes completely unfastened, the fail safe projection 69 will hold the back strap 15 in position preventing any injury to the user.

What is claimed is:

1. A chair control for supporting a seat and a back rest, comprising; a seat frame, a back member projecting rearwardly from said seat frame, said back member having a generally vertial wall, an elongated aperture in said wall, a back rest support extending upwardly from said back member for supporting a back rest at the upper end thereof, said back rest support having a T-shaped projection extending, the top of the "T" having a length greater than the width of the elongated aperture in said back member so that the projection may be inserted in said aperture and the back rest support rotated 90° holding the back rest support on said back member, and fastening means for holding said back rest support to said back member.

2. A chair control for supporting a seat and a back rest, comprising; a seat frame, a back member projecting rearwardly from said seat frame, said back member having a generally vertical wall, an elongated aperture in said wall, a back rest support, said back rest support having a T-shaped projection extending therefrom, the top of the "T" having a length greater than the width of the elongated aperture in said back member so that the projection may be inserted in said aperture and the back rest support rotated 90 degrees holding the back rest support on said back member, including means for fixing said back rest support to said back member, said means for fixing said back rest support to said back member including an opening in said back rest support spaced from said T-shaped projection, and a threaded fastener extending through said elongated aperture in said back member and said opening in said back rest support.

3. A chair control as defined in claim 2, in which said threaded fastener has a polyagonal head engaging the T-shaped projection.

4. A chair control for supporting a chair seat and a seat back, comprising; a seat frame, a control body pivotally mounted on said seat frame, said control body being movable to first and second limit positions, means biasing said control body to one of said positions, a back hinge pivotally mounted on said control body, a threaded member engaging said control body and said back hinge for adjusting the pivotal position of the back hinge, an elongated aperture in said back hinge, a spring means continuously biasing said back hinge in one direction, a back support extending upwardly from said back hinge for supporting a back rest at the upper end thereof, said back support having a T-shaped projection extending therefrom, the top of the "T" having a length greater than the width of the elongated aperture in said back hinge so that the projection may be inserted in said aperture and the back support rotated 90 degrees holding the back support on said back hinge, and fastening means for holding said back support to said back member.

* * * * *